US006889855B2

(12) United States Patent
Nagel

(10) Patent No.: US 6,889,855 B2
(45) Date of Patent: May 10, 2005

(54) PRODUCT PUSHER FOR MERCHANDISE DISPLAYS

(75) Inventor: Thomas O. Nagel, Blairstown, NJ (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 10/232,509

(22) Filed: Aug. 30, 2002

(65) Prior Publication Data

US 2004/0000528 A1 Jan. 1, 2004

Related U.S. Application Data

(63) Continuation-in-part of application No. 10/024,153, filed on Dec. 17, 2001, now Pat. No. 6,719,152.

(51) Int. Cl.[7] ..... A47F 7/00
(52) U.S. Cl. ..... 211/59.3
(58) Field of Search ..... 211/59.3, 59.2, 211/94.01, 162

(56) References Cited

U.S. PATENT DOCUMENTS

| | | | | |
|---|---|---|---|---|
| 1,703,987 A | | 10/1929 | Butler | |
| 2,079,754 A | | 7/1937 | Waxgiser | |
| 3,110,402 A | * | 11/1963 | Mogulescu | 211/59.3 |
| 3,308,961 A | | 3/1967 | Chesley | |
| 4,130,203 A | | 12/1978 | Russell, III | |
| 4,303,162 A | * | 12/1981 | Suttles | 211/59.3 |
| 4,899,893 A | | 2/1990 | Robertson | |
| 5,069,349 A | * | 12/1991 | Wear et al. | 211/59.3 |
| 5,366,099 A | | 11/1994 | Schmid | |
| 5,730,320 A | | 3/1998 | David | |
| 5,855,283 A | | 1/1999 | Johnson | |
| 6,357,606 B1 | | 3/2002 | Henry | |

FOREIGN PATENT DOCUMENTS

| | | |
|---|---|---|
| GB | 1299451 | 12/1972 |

* cited by examiner

*Primary Examiner*—Hugh B. Thompson, II
*Assistant Examiner*—Sarah Purol
(74) *Attorney, Agent, or Firm*—Schweitzer Cornman Gross & Bondell LLP

(57) ABSTRACT

A display assembly for the display of merchandise packages with provisions for moving product packages toward the front as packages are removed by customers. A pusher sled is formed of front and back plastic wall panels, joined at the top and spaced apart at the bottom, with side opening notches near the bottom for sliding engagement with spaced apart, wire-like supports. A coiled strip spring has its coiled body confined between the wall panels and a strip portion thereof extends through an opening in the front wall panel to an anchor point at the front of assembly. Exceptional economies are realized in the manufacture of the display assembly while providing a system which aesthetically attractive, with superior performance. A variety of simple clip-on or snap-on devices may be used for anchoring the front of the coil spring, including a clip-on label holder element which mounts at the front of the assembly and includes a slot for reception of a forward end of the spring.

24 Claims, 8 Drawing Sheets

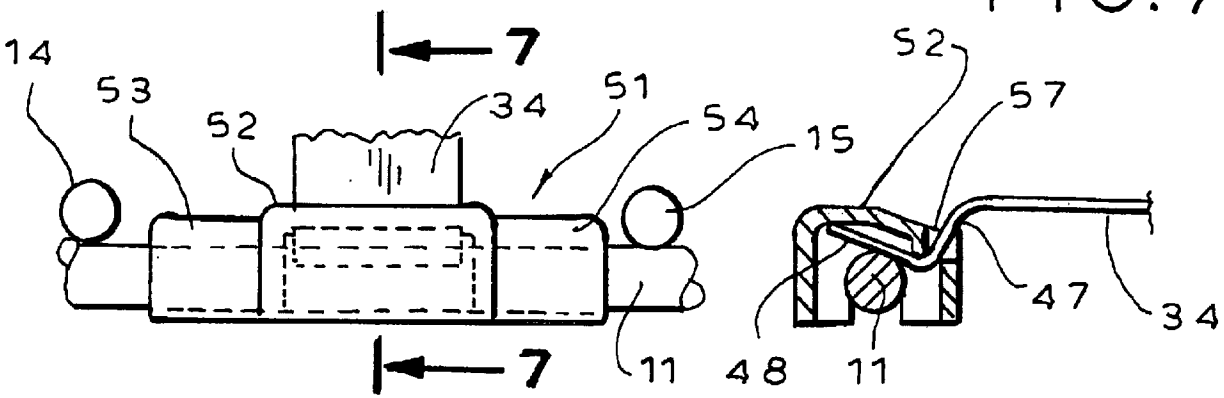
FIG. 5
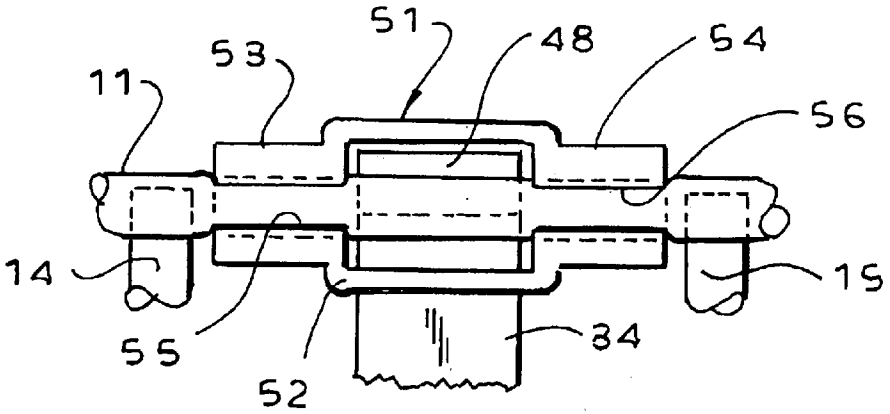
FIG. 6
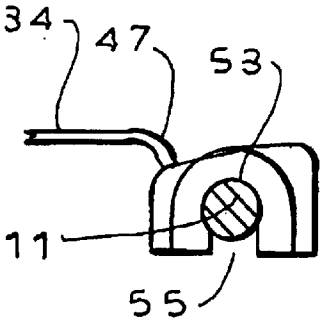
FIG. 8
FIG. 7

PRODUCT PUSHER FOR MERCHANDISE DISPLAYS

RELATED APPLICATIONS

This application is a continuation-in-part of our U.S. application Ser. No. 10/024,153, filed Dec. 17, 2001 now U.S. Pat.No. 6,719,152.

BACKGROUND OF THE INVENTION

Product display and shelf management frequently requires, or at least desires, that a supply of displayed products of the same type, which may be aligned front to back on a display shelf or rack, be constantly urged forwardly, as product items are removed, so that the product is always available for display at the front of the display device. A variety of devices and systems have been proposed over the years for accomplishing this objective. Most have had shortcomings either in the form of cost or performance or, in many cases both. In a typical case, pusher mechanisms have been designed as self-contained mechanisms that are installed in a display rack and function as an independent mechanism. In some cases, the entire display rack is specially designed to incorporate an intricate form of pusher mechanism. In our above mentioned co-pending application, we have disclosed an improved form of pusher mechanism in which a pusher element is mounted for slideable movement on the elements of a wire display rack, resulting in a significantly simplified and more economical system. The present invention seeks to provide a product pusher system that improves further upon that disclosed in our co-pending application and is an ultimate in simplicity, highly reliable in function and capable of being made available at a minimum cost.

SUMMARY OF THE INVENTION

In accordance with the present invention, a novel and improved pusher arrangement is provided for a display rack comprising at least two laterally spaced wire elements, extending from front to back of the display device. Typically, although not necessarily, these wire elements form a slidable support for the display product.

A novel and uniquely simplified pusher arrangement is provided, in which the pusher element is a single piece of plastic sheet material, advantageously rigid vinyl, consisting of front and back panels joined integrally at a top fold, in a generally inverted "V" configuration, with a front panel advantageously disposed generally vertically and the other extending downward and rearward at a shallow angle relative to the front panel. The panels are formed with laterally opening notches at each side, adjacent their bottom edges, of a suitable size to loosely receive the spaced apart wire elements, which both guide and support the pusher element. To advantage, the wire supports are painted, to provide a smooth, low friction contact with the plastic panels, enabling them to slide freely in forward and rearward directions along the support wires.

Where additional, intermediate front to back support wires are provided on the display rack, the plastic panels of the pusher element are formed with downwardly opening notches along their lower edges, aligned with the intermediate support wires, such that the pusher element may move freely back and forth over the intermediate support wires without interference.

In accordance with one feature of the invention, a thin, coiled spring strip is positioned and confined between the front and back pusher panels, with the strip exiting through a confining opening in the front panel. The forward end of the spring strip is anchored at the front of the display rack such that the pusher element is constantly urged in a forward direction. No special housings or containments are required for the spring. It is allowed to float freely between the front and back panels of the pusher. The overall arrangement of the pusher device is one of ultimate simplicity and extraordinarily low cost, while at the same time functioning in a manner which is superior to more complicated and expensive systems.

In one advantageous form of the invention, the forward end of the spring strip is anchored by means of a label holder attached to the front of the display rack. This is particularly advantageous where the display rack is mounted on a display panel, for example, and carries its own price information. For a rack mounted on a display panel, but not requiring pricing information, the spring strip may be advantageously anchored by means of a small plastic clip attached to the front of the display rack. In other forms of the invention, where the display rack is designed to be mounted on a shelf, and includes plastic base members at the front and back for supporting and positioning the rack, the spring strip may advantageously be anchored by means of the front plastic base element.

One of the uniquely advantageous features of the invention is the ability of the pusher element to reconfigure itself as a function of the loading of the display rack. In this respect, in order to be able to load the display rack to its absolute maximum capacity, the pusher element, normally of inverted V-shaped configuration, reconfigures itself such that the front facing wall becomes vertically disposed, and the back facing wall bows out rearwardly, typically enabling one or more packages to be inserted into the display. Likewise, the inverted V-shaped configuration of the pusher may be designed to provide an initial forward tilt to the front face of the pusher. With this arrangement, when the pusher reaches the forward limit of its pushing movement, typically a short distance away from the absolute front of the display rack because of mechanical considerations, the forward tilt of the pusher front face assures that the remaining product item or items is as close to the front of the display as practicable.

For a more complete understanding of the above and other features and advantages of the invention, reference should be made to the following detailed description of preferred embodiments, and to the accompanying drawings.

DESCRIPTION OF THE DRAWINGS

FIG. 5 is a fragmentary front elevational view of a second embodiment of the invention, in which a plastic clip device is utilized at the front of the display rack to anchor the pusher spring.

FIG. 6 is a bottom plan view of the clip device of FIG. 5.

FIG. 7 is a cross sectional view as taken generally on line 7—7 of FIG. 5.

FIG. 8 is an end elevational view of the device shown in FIG. 5.

DESCRIPTION OF PREFERRED EMBODIMENTS

Figure 1:
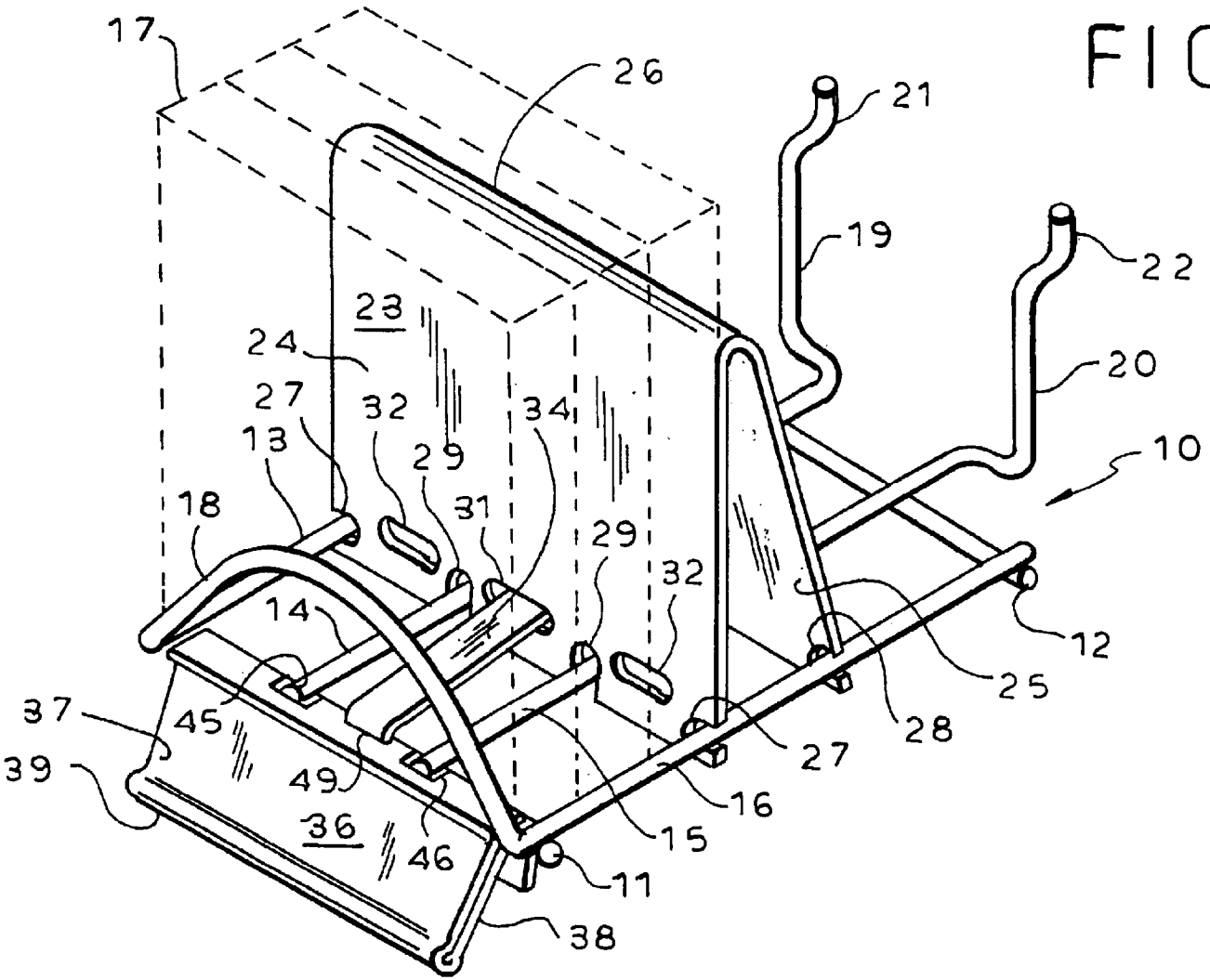
FIG. 1 is a perspective view of a first embodiment of a display rack incorporating the pusher mechanism of the invention, in which the pusher spring is anchored by a label holder attached to the front of the display rack.

Referring now to the drawings, and initially to FIGS. 1–4 thereof, the reference numeral 10 designates generally a wire display rack of a type adapted for mounting on a display panel, such as apertured panel board, slat wall, etc. The rack is comprised of front and back cross bar wires 11, 12 to which are secured (typically by welding) a plurality of longitudinal support wires 13–16. The four longitudinal wires 13–16 are supported in a common plane and provide support for merchandise packages 17, indicated in broken lines in FIG. 1.

In the illustrated form of the invention, the laterally outer wire supports 13, 16 are joined at their front ends by an integral looped portion 18, which forms a vertical front stop for the packaged items 17. The internal support wires 14, 15 terminate at their forward ends at the front cross bar 11. At their back ends, the wire supports 14, 15 extend beyond the rear cross bar 12 and are shaped to form upwardly extending portions 19, 20 terminating in hook portions 21, 22 respectively. The hook portions 21, 22 are adapted to be received in openings provided in apertured panel board, slat wall panels, etc., such that the display rack can be mounted on a display panel with the support wires 13–16 extending outwardly therefrom for displaying the merchandise packages 17.

Pursuant to the invention, the display rack 10 is provided with a unique form of pusher sled 23, which is comprised of a single sheet of rigid vinyl material, preferably extruded as a continuous section and cut to length. The pusher sled includes a flat front panel 24 preferably generally vertically disposed, and a similar, generally flat back panel 25, which is joined at its upper edge with the front panel along a rounded fold 26 and preferably extends downward at a slight angle (for example 15 degrees) to the plane of the front wall 23. The sled 23 preferably extends across the full width of the display rack and the respective panels thereof include laterally opening notches 27, 28. The notches are horizontally disposed and have a height slightly greater than the diameter of the outside wires 13, 16, so as to be received over the wires for easy sliding movement in forward and rearward directions.

In the illustrated form of the invention, where the display rack includes a pair of internal support wires 14, 15, the sled panels 24, 25 are provided with downwardly opening notches 29, 30 which loosely receive the internal wires 14, 15 to accommodate easy forward and rearward sliding movement of the sled, with the sled being supported by the laterally opening notches 27, 28. The downwardly opening notches 29, 30 advantageously are large enough to provide a clearance space above the internal wires 14, 15. However, the space between inside edges of the vertical notches 29, 30 beneficially can be such that, when the sled is aligned perpendicularly across the display rack 10, the inside edges of the vertical notches 29, 30 are close to the inside surfaces of the wires 14, 15, in order to insure proper lateral alignment of the sled 23 relative to the wires 13–16 during forward and rearward movements of the sled.

Figure 3:
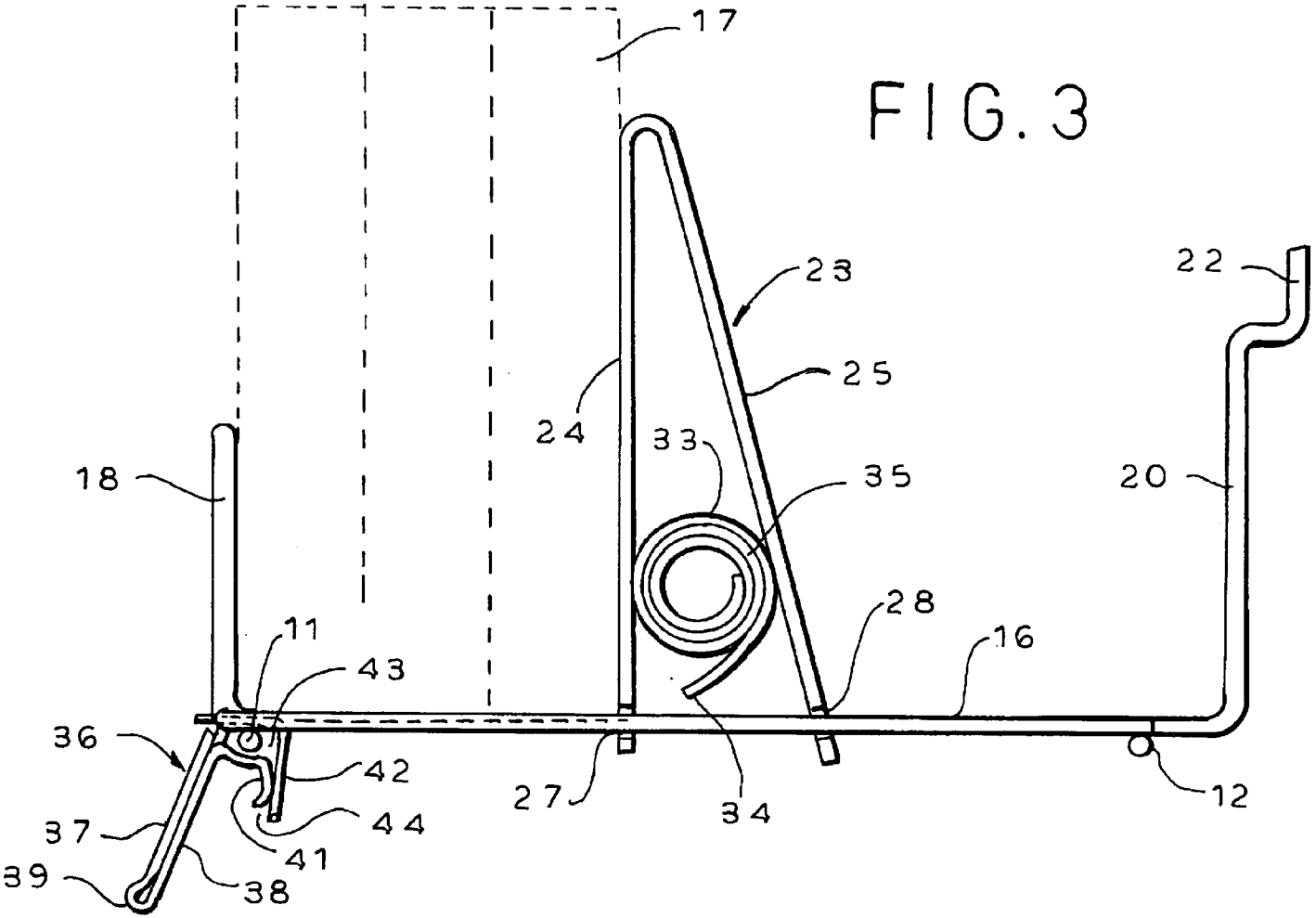
FIG. 3 is a side elevational view of the device of FIG. 1.

The sled 23 preferably is produced by continuous extrusion of rigid vinyl material, in the cross sectional configuration shown in, for example, FIG. 3, with a generally uniform material thickness of approximately 1/16th of an inch. As the material exits the extrusion operation, it can be cut to desired lengths, which may vary according to the particular size and shape of the display rack, as will be understood. In conjunction with the cutting to length of the individual sleds, they will be preferably processed at the same time to form the several laterally opening side notches 27, 28 and downwardly opening vertical notches 29, 30. The operations involved are inexpensive and efficient, resulting in a sled which can be produced at far less cost than by the more typical production processes involving injection molding, for example.

At the same time that the several notches 27–30 are being formed in the sled, the front panel 24 of the sled is also being provided with one or a plurality of short, horizontal slots 31, 32. In the illustrated form of the invention, the slot 31 is formed in the center of the front panel 24, while two additional slots 32 are formed, one on either side of the center slot 31, generally aligned with the spaces between the pairs of longitudinal wires 13–14 and 15–16. The slots 31, 32 perform an important function with respect to positioning and confinement of a coiled strip pusher spring 33, as will be more fully described.

In order to install the sled 23 onto the display rack 10, the front and back panels 24, 25 are squeezed closely together along their bottom edges until the bottom edges are substantially in contact. The thus compressed panels are then disposed at an angle to the perpendicular, with respect to the support wires 13–16 of the rack, and the panels may be distorted slightly if necessary, to enable the laterally opening notches 27, 28 to be received over the outer support wires 13, 16. In this respect, the respective front and back sled panels 24, 25 are preferably slightly wider than the width of the display rack, as defined by the outside support wires 13, 16, such that the compressed sled panels must be disposed at an angle and/or distorted in order to fit in the space between the outside wires 13, 16. Once the laterally opening notches 27, 28 are aligned with the outside wires 13, 16, the panels may be rotated to a perpendicular orientation, across the width of the display rack, and they may be released from a compressed condition and allowed to assume a normal configuration as shown in FIGS. 1 and 3, for example, with the panel bottom edges spaced apart. The width of the downwardly opening notches 29, 30 is sufficiently greater than the diameter of the inner support wires 14, 15 to accommodate the described angular orientation of the sled panels 24, 25 during the installation operations.

Once the sled 23 is properly positioned on the support wires, it is vertically supported by the outside wires 13, 16 and laterally guided by the inside wires 14, 15.

The sled 23 is intended to be movable in a substantially friction free manner in forward and rearward directions along the support wires 13, 16. The vinyl material itself, of which the sled 23 is formed, has advantageous low friction characteristics. Additionally, we have found it to be very advantageous to provide a painted coating on the outer surfaces of the support wires 13, 16, as this results in a further significant reduction of sliding friction of the sled 23. Advantageously, painting can be performed after construction and assembly of the wire elements of the rack, preferably by an electrostatic powder coating operation, in which the paint is cured and fused under heat immediately following electrostatic powder coating operations.

Pursuant to the invention, the coiled strip spring 33, in itself typical of those used for activating product pusher sleds, is positioned between the front and back panels 24, 25 of the sled 23, but is not otherwise housed or confined. The outer end section 34 of the spring is led outward through the horizontal slot 31 in the front wall panel 24 and extends to the front of the display assembly, where it is anchored in a manner to be described. The uncoiled end portion 34 of the spring is both supported and confined by the edges of the slot 31, which in turn serves to support and position the coiled body 35 of the spring. No additional confinement for the spring 33 is required. The natural tendency for the spring 33 to recoil itself, causes the spring to press forwardly against the inside surface of the front panel 24, constantly urging the sled 23 in a forward direction to move the packages 17 to the front of the display, up against the front stop 18. As the sled 23 moves forward and rearward on the wire supports 13, 16, the spring 33 simply uncoils or recoils, depending upon the direction of movement.

In a display assembly in which the rack is mounted on a display panel, it is frequently necessary to provide a label holder for the display of pricing and other product information. When the use of a label holder is necessary or desirable for that purpose, it is convenient to utilize the label holder in the additional capacity of providing a means for anchoring the forward end of the pusher spring 33.

In the embodiment of the invention illustrated in FIGS. 1–4, the free end 34 of the spring is anchored in a novel and advantageous manner by means of a label holder 36 mounted at the front of the display rack. The label holder consists of a plastic extrusion, formed with front and back primary panels 37, 38 joined at their bottom edges 39 to form a pocket for receiving an information label 40. The label holder is designed for clip-on attachment to the front cross bar 11 of the display rack. To this end, the label holder includes first and second integral clip elements 41, 42 which define an enclosure 43 for the reception of the cross bar 11 and a restricted opening 44 to enable the label holder to be clipped onto the cross bar and retained thereon unless intentionally removed.

Figure 2:
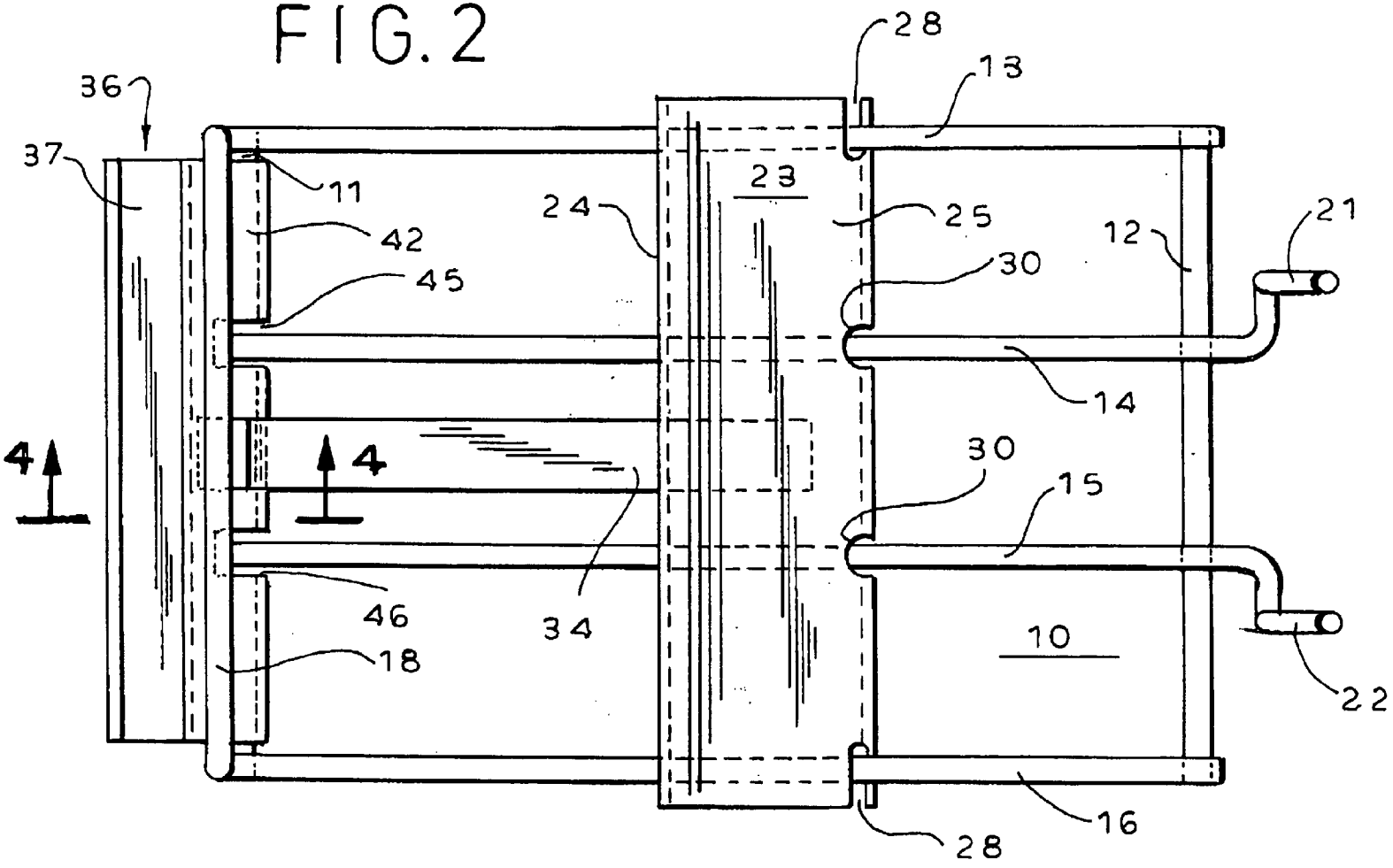
FIG. 2 is a top plan view of the device of FIG. 1.

The illustrated form of label holder advantageously is of extruded construction, cut to a length to fit between the outside wire support elements 13, 16, as reflected in FIG. 2. In addition, the clip-forming elements 41, 42 are provided with notched-out portions 45, 46, shown in FIG. 2, to accommodate the presence of the inside wire support elements 14, 15.

Figure 4:
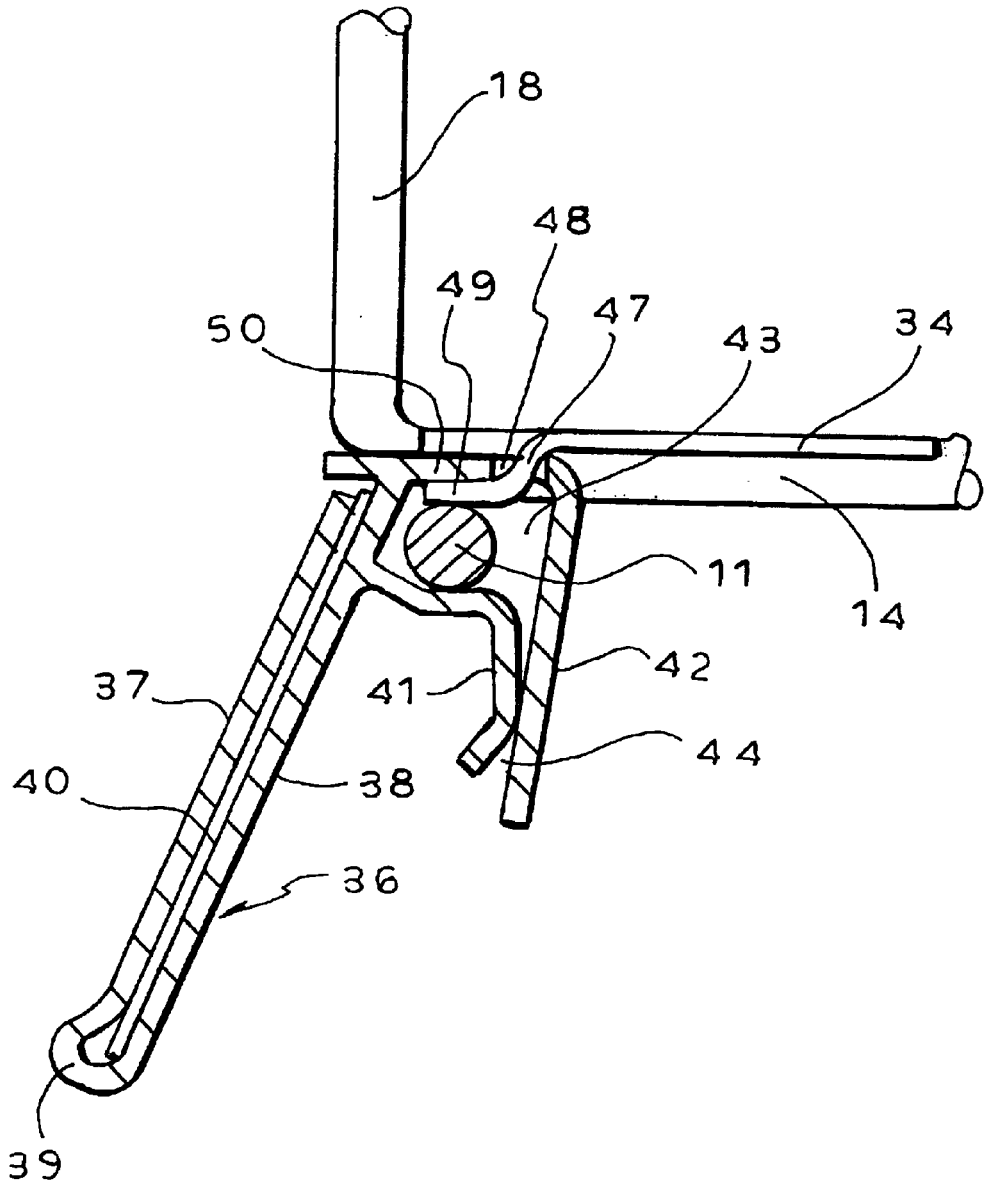
FIG. 4 is an enlarged, fragmentary cross sectional view as taken generally on line 4—4 of FIG. 2.

As shown particularly in FIG. 4, the forward extremity of the spring section 34 is permanently bent to provide first and second offset portions 47, 48. The first portion 47 extends generally downward, and the second offset portion 48 extends forward, generally parallel to the main portion of the spring section 34, as indicated in FIG. 4. The spring section 34 is anchored to the label holder by inserting the offset portions 47, 48 downwardly through a slot 49 formed in an upper wall portion 50 of the clip-forming element 42. To advantage, the spring end is inserted into the slot 49 before the label holder is mounted on the cross bar 11. Thereafter, when the label holder is installed onto the cross bar 11 in the manner shown in FIG. 4, the spring end portion 47, 48 is effectively locked in the slot 49 against other than intentional removal.

In the illustrated form of the invention, multiple pusher springs 33 may be employed if desired, to provide an additional pushing force for handling of products of greater weight. For example, in the specific embodiment illustrated in FIGS. 1–4, any combination of one, two or three springs may be employed. The use of a single spring is specifically illustrated in FIGS. 1–4. If two springs were desired, they would be installed and confined between the front and back pusher walls, substantially as indicated in FIG. 3, with forwardly extending portions of the springs passing through the outboard slots 32 and anchored forwardly in the label holder 36, by means of anchor slots (not shown) corresponding to the slot 49. If a third spring were desired, the illustrated central spring would be retained, along with two additional springs extended through the outboard openings 32. Pursuant to the invention, the use of multiple pusher springs requires no additional complicated moldings or the like. This provides for a high degree of flexibility in the setup of the display assembly, without any significant additional cost.

In some circumstances, display racks may be mounted on a display panel without the need or desire for a label holder to be mounted at the front of the display rack. In such cases, a simple, easily attached clip-on anchor device of the type shown in FIGS. 5–8 may be employed to secure the forward end of the pusher spring or springs. The anchor clip of FIGS. 5–8 advantageously is a molded plastic part consisting of a central enclosure 52 with integral clip portions 53, 54 extending from opposite sides thereof. The clip portions 53, 54 advantageously are of inverted U-shape configuration, formed with downwardly facing entrance openings 55, 56 of somewhat smaller width than the diameter of the front cross bar wire 11. The arrangement is such that the clip-on device 51 may be mounted on the cross bar wire 11 by pressing downwardly on the clip portions 53, 54 on each side of the enclosure 52 until the device snaps into place snugly gripping the wire 11.

The overall length of the clip-on device 51 is slightly less than the space between the internal support wires 14, 15, and also somewhat less than the spaces between the wires 13–14 and 15–16. Accordingly, the clip-on device 51 can be installed in any or all of the three spaces formed by the support elements 13–16, to accommodate one, two or three pusher springs.

As shown in FIG. 7, the enclosure 52 is provided with a thin vertical slot 57 for receiving the offset end portions 47, 48 of the spring end 34. These offset portions 47, 48 are inserted in the slot 57 before the clip-on device 51 is installed on the cross bar wire 11. Once the clip device is installed, the offset end portions 47, 48 are effectively locked to the clip-on device by the presence of the cross bar element 11, as is indicated in FIG. 7.

Figure 9:
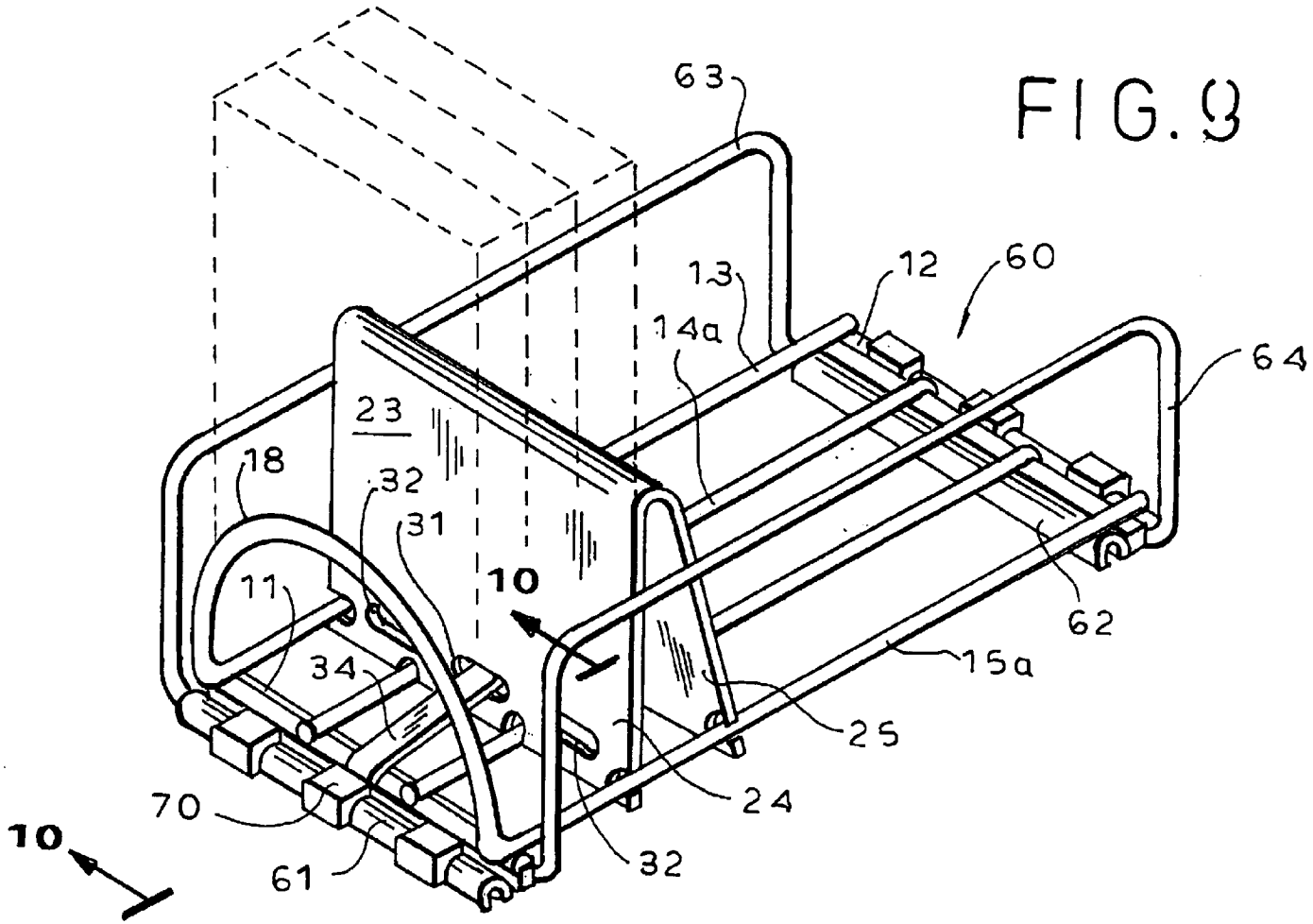
FIG. 9 is a perspective view of a third embodiment of the invention, in which the pusher spring is anchored by means of a plastic base member attached to the front of the rack and used for the mounting of adjustable side supports.
Figure 10:
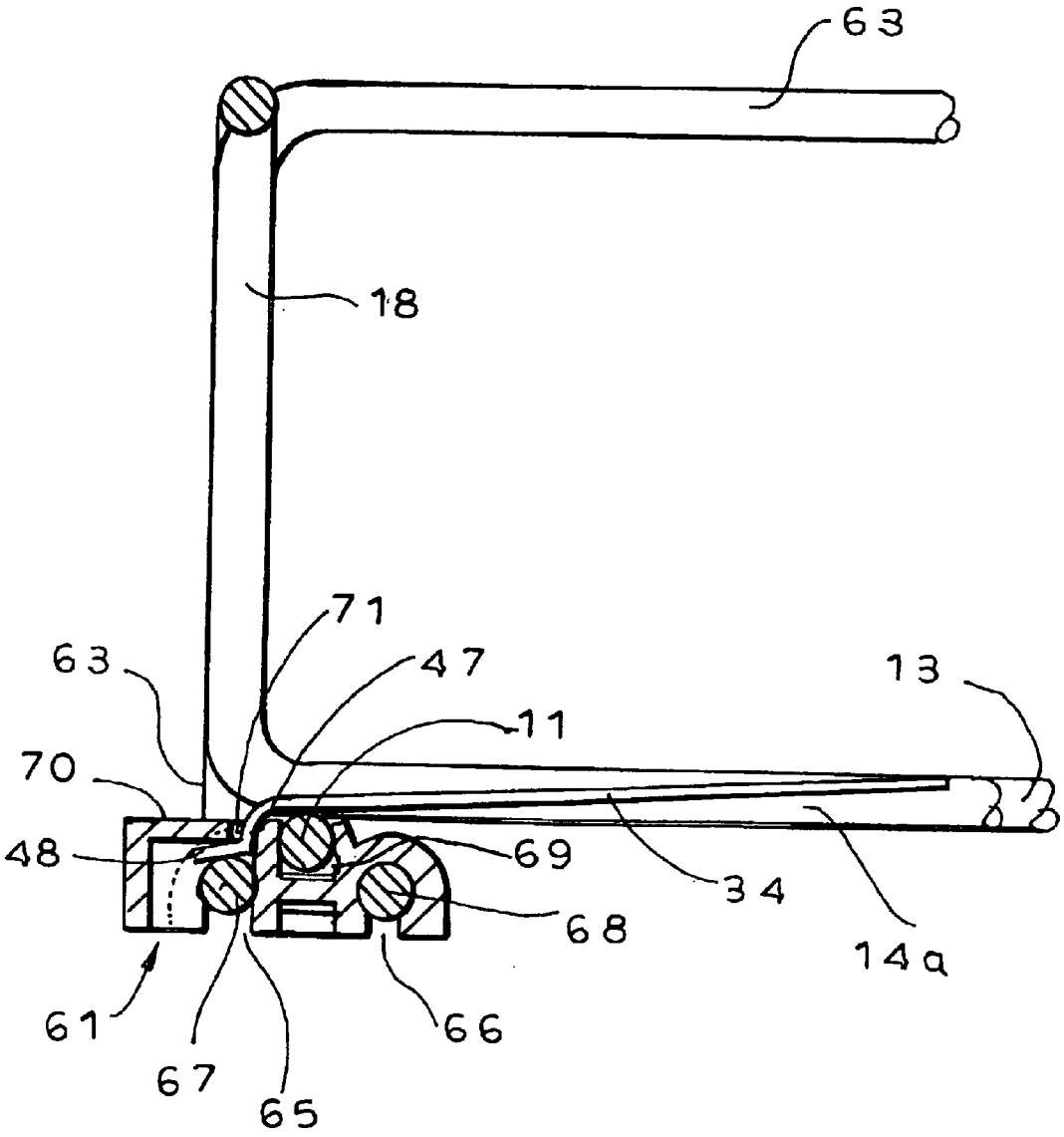
FIG. 10 is an enlarged, fragmentary cross sectional view as taken generally on line 10—10 of FIG. 9.

In yet another embodiment of the invention, shown in FIGS. 9 and 10, a display rack 60 is designed to be supported on a shelf, for example, rather than being suspended on a display panel as in the embodiment shown in FIGS. 1–4. The display rack 60 of FIGS. 9 and 10 include spaced-apart support elements 13, 16 joined at the front by an integral, upwardly extending loop 18 forming a front stop. Front and back cross bar elements 11, 12 are fixed to the wire supports 13, 16 at opposite ends thereof. Internal wire supports **14*a*, 15*a* are fixed at opposite ends to the respective cross bars 11, 12 and function generally in the same manner as support elements 14, 15 of the first-described embodiment, except that the elements 14*a*, 15*a* terminate at the back cross bar element 12**.

A pusher sled 23, which can be the same as, and will function the same as the pusher sled of the FIGS. 1–4 embodiment, is mounted on the support elements 13–16 and houses a coil spring (not shown) between its front and back panels 24, 25. A forward extension 34 of the spring extends through a horizontally elongated opening 31 in the front wall panel 24 to an anchor point at the front of the display rack.

The embodiment of FIGS. 9 and 10 incorporates special plastic base members 61, 62 at the front and back which attach to the cross bars 11, 12 and support the display rack a short distance above a shelf or other support surface upon which the base members are resting, in order to allow the pusher sled 23 to move freely over the top of the surface.

An important function of the base member 61, 62, which is described more fully in our co-pending application Ser. No. 10/024,153 and application Ser. No. 10/219,800, filed Aug. 16, 2002 is to mount adjustable side guides 63, 64. The side guides, and the features of the base members 61, 62 which accommodate them, do not form features of the present invention, but are conveniently utilized in certain cases where lateral confinement of the product is important. Indeed, even in a rack configuration of the general type shown in FIG. 1, for example, where the rack is designed to be mounted on a display panel, it may be desired to utilize base members 61, 62 in order to enable the use of the adjustable side guides 63, 64.

In the embodiment of FIGS. 9 and 10, the base members 61, 62 typically will be of identical construction, preferably injection molded using an engineering plastic material, such as Celcon, an acetal polymer marketed by Celanese Corporation. As indicated in FIG. 10, the base members include first and second downwardly opening transverse recesses 65, 66 for the reception of transversely extending portions 67, 68 of the respective side guides 63, 64. The transverse elements 67, 68 are snugly received in the recesses 65, 66 to accommodate transverse adjustment thereof while effectively retaining the side guides in their adjusted positions during normal use.

An upwardly opening recess 69 is provided in the base member to receive the cross bar element 11. The entrance opening into the recess 69 is slightly less than the diameter of the cross bar element 11, enabling the element to be inserted into the recess 69 by a snap-in action and retained therein until intentionally separated.

Pursuant to the invention, the base members 61, 62 are formed with one or more hollow enclosures 70. Preferably, there are as many of the hollow enclosures 70 as there are slotted openings in the pusher sled 23, with the enclosure 70 being generally aligned with such slotted openings, as reflected in FIG. 9.

As shown in FIG. 10, the enclosures 70 are formed with an entrance slot 71 for the reception of offset portions 47, 48 of the spring section 34. In order to insert the offset portions 47, 48 into the slot 71, the adjustable guide 63 is withdrawn sufficiently to clear its transverse portion 67 to a position away from the slot 71. The offset portions 47, 48 may then be inserted into the slot and allowed to assume a normal position, with the offset portion 48 disposed in the space above the transverse rod portion 67, as reflected in FIG. 10. Once the spring end is installed, the normal forces applied thereto, which are directed generally horizontally, will not cause the spring end to be withdrawn from the slot 71.

Although only a single spring is illustrated in FIG. 9, it will be understood that one two or three springs may be employed in the specifically illustrated embodiment, as previously explained.

Figure 11:
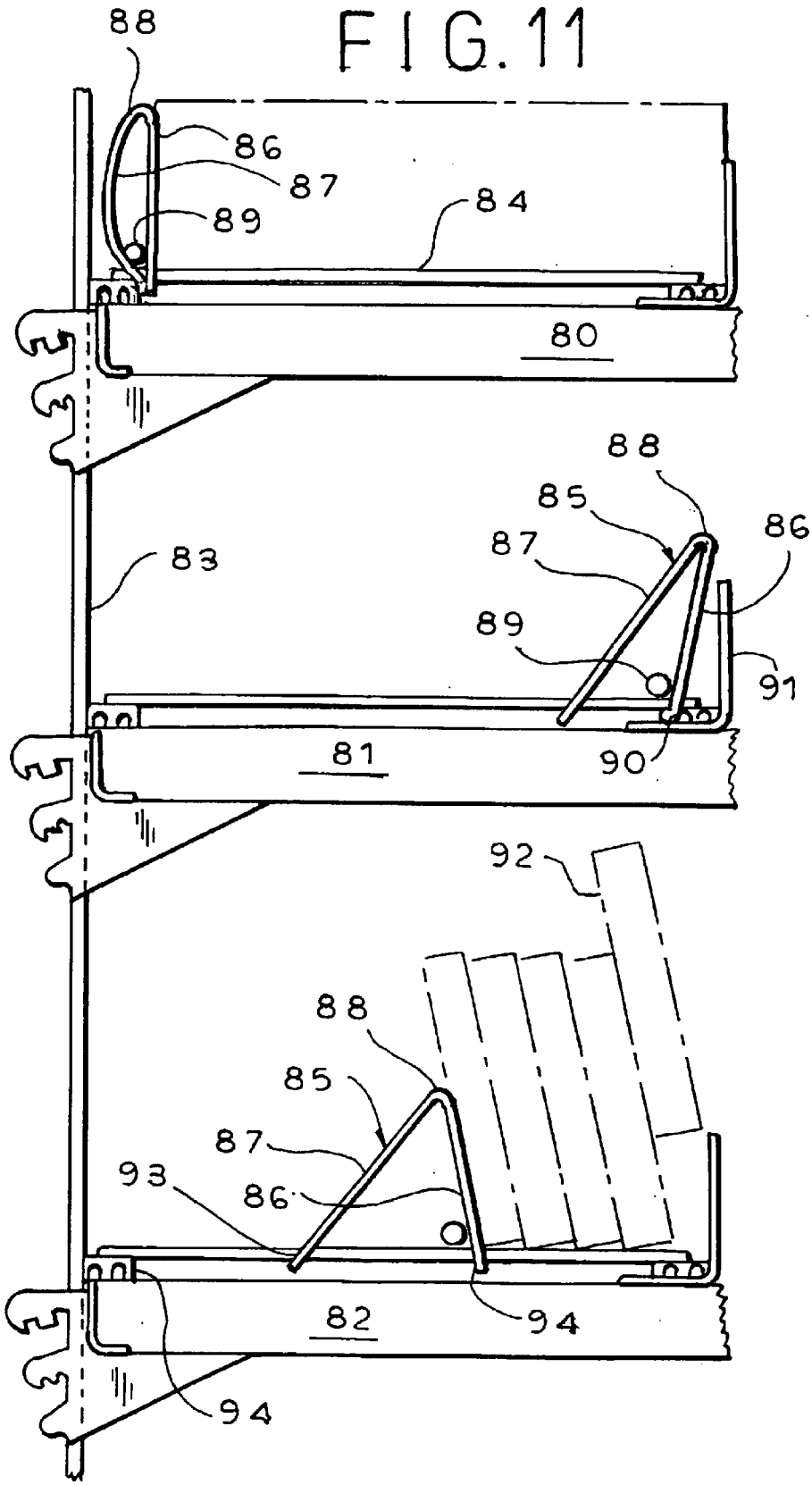
FIG. 11 is a simplified end view of a display rack incorporating a modified form of pusher arrangement according to the invention, illustrating three levels of display assemblies, each with the pusher in a different position and different configuration.

An advantageous modification of the invention is shown in FIG. 11 in which rack displays 80, 81 and 82 are shown mounted at various levels on a display panel 83. Each of the displays 80–82 is identical construction, comprising a rack formed of two or more spaced apart wire rods 84 extending from front to back and slideably supporting a pusher sled 85. In general, the pusher sled 85 corresponds to the sled 23 previously described, consisting of front and back pusher panels 86, 87 respectively joined at the top 88. The panels 86, 87 are formed with openings near the bottom edges thereof corresponding in general to those of the pusher sled 23, enabling the sled 85 to slide easily in front-to-back and back-to-front directions along the wire rods 84 of the display rack. A coiled strip spring 89 is positioned between the front and back pusher panels 86, 87 and has a portion passing through a front opening (not shown in FIG. 11) and extending forward to an anchor point at the front of the display, all as previously described herein.

In the modified form of the invention shown in FIG. 11, the inverted V-shaped configuration of the pusher sled 85 is characterized by the front panel 86 being considerably shorter than the back panel 87. As a result, when the sled is in a "normal" position, not being under any stress, the sled has a forward lean configuration shown in the middle level display 81 of FIG. 11.

As shown in the middle level display 81 of FIG. 11, the forwardmost position of the sled 85 is limited by engagement of the forward panel 86 with a base 90 of the display rack. Typically, this is some distance behind the front stop element 91 of the display rack, as is evident in the display 81. However, by reason of the forward lean of the pusher front panel 86, the upper portion of the front panel is substantially closer to the front stop 91 than the lower portion. As a result, even a thin package mounted in the display rack can be pushed forward into contact with the front stop 91, or substantially so, by upper portions of the front panel 86.

During loading of the display rack with product items, the sled 85 is progressively pushed back, as reflected in the lower display unit 82 of FIG. 11. During the loading process, the front panel 86 can be tilted rearwardly, by pressure against upper portions thereof. The back panel 87 in such a case will reorient itself, by widening the base of the inverted V. This action is easily accommodated by the somewhat flexible connection 88 between the front and rear panels, which are preferably formed in a continuous extrusion process, but are configured in the nature of flat, folded sheet-like panels.

Upon continued insertion of product items 92 into the display, the point eventually will be reached when the lower portion 93 of the back panel engages the rear base member 94 of the display rack. This forms a positive stop against further movement of the lower portion 93 of the panel. However, as a unique and advantageous feature of the invention, the pusher sled 85 can be displaced further to the rear by continued insertion of product items until the bottom portion 94 of the front panel 86 contacts or nearly contacts the bottom portion 93 of the back panel. To enable this, the back panel 87 bows outward to the rear, as shown in the upper display 80 of FIG. 11. The coiled strip spring 89, which at this point is considerably smaller than when the sled is in its forwardmost position, is displaced upward, if necessary, into the upwardly enlarging space defined by the lower portions of the respective front and back panels 86, 87.

By enabling the front panel 86 to be displaced rearwardly to a limit position in which it contacts the lower end of the back panel, additional space is provided in the display rack for inserting one or two additional product items (depending, of course, upon the thickness of the product packaging).

In any of its forms, the assembly of the invention provides an extraordinarily effective and economical arrangement for pushing products forward in a product display. The pusher sled itself is essentially a flat sheet of plastic, configured in an inverted V-shaped form, which can easily be produced by continuous extrusion. The design of the sled and its configuration is such that the pusher spring can simply be confined between the front and back walls of the sled, without any other containment walls. The assembly is one of ultimate simplicity and economy and represents a significant advance over known apparatus for this purpose.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A display assembly for the display of multiple merchandise packages with provisions for moving product packages toward a front of the assembly as packages are removed by customers, which comprises (a) a display rack comprising a pair of spaced-apart, parallel support elements arranged to extend outward in a point of purchase product display, (b) a product pusher mounted on said support elements for forward and rearward sliding movement, for urging packages to the front of said display assembly, (c) said product pusher a sheet-like structure of plastic material including generally upright front and back wall panels having lower edges, with said back panel being joined along an upper edge portion thereof to said front panel and said panels having bottom edge margins spaced apart in the direction of said sliding movement, (d) said front and back wall panels having open-sided notches therein adjacent said bottom edge margins slideably engaging said support elements, (e) a coiled strip spring for urging said product pusher in a forward direction, (f) an anchor element at a forward end of said display rack for securing one end of said spring, (g) spaced apart internal surfaces of said wall panels forming a confinement for a coiled body of said strip spring with said coiled body urging said product pusher in a forward direction, (h) said product pusher, at least in its bottom edge margins, having a width greater than a space between said support elements whereby said product pusher is supported by engagement of opposed pairs of said open sided notches in said front and back wall panels.

2. A display assembly according to claim 1, wherein (a) said open-sided notches being generally horizontally disposed and opening at side edges of said front and back wall panels.

3. A display assembly according to claim 2, wherein (a) one or more cross bar elements join said support elements adjacent front and back ends thereof, (b) said panels are sufficiently flexible to enable the lower edges of the front and back panels to be temporarily compressed together for mounting of said product gusher on said display rack, and (c) said product pusher is assembled to said display rack by temporarily compressing said lower edge margins closely together and temporarily orienting the thus compressed product pusher at an angle of less than 90 degrees with respect to said support elements to enable said open-sided notches to be engaged with said support elements.

4. A display assembly according to claim 1, wherein (a) at least portions of said open-sided notches are generally horizontally disposed, and (b) said support elements are received in said generally horizontally disposed portions.

5. A display assembly according to claim 1, wherein (a) said product pusher is of continuously extruded construction, cut to predetermined width.

6. A display assembly according to claim 5, wherein (a) said product pusher is formed of rigid vinyl plastic.

7. A display assembly according to claim 1, wherein (a) said front wall panel is formed with a narrow, horizontally disposed slot therein adjacent to the lower edge margin thereon, and (b) said coil strip spring has a portion extending through said slot and forward to said anchor element, (c) said coil spring being vertically supported by bottom edge portions of said horizontally disposed slot.

8. A display assembly for the display of multiple merchandise packages with provisions for moving product packages toward a front of the assembly as packages are removed by customers, which comprises (a) a display rack arranged to extend outward in a point of purchase product display, (b) a product pusher mounted on said display rack for forward and rearward sliding movement thereon, for urging packages to the front of said display assembly, (c) said product pusher comprising an extruded sheet-like structure of plastic material including front and back wall panels joined along top edge margins thereof in a generally inverted V-shaped configuration and having bottom edge margins spaced apart in the direction of said sliding movement, (d) said front and back wall panels slideably engaging said display rack, (e) a coiled strip spring for urging said product pusher in a forward direction, (f) an anchor element at a forward end of said display rack for securing one end of said spring, (g) spaced apart internal surfaces of said wall panels forming front and back confinement for a coiled body of said strip spring with said coiled body urging said product pusher in a forward direction, and (h) the front wall panel of said product pusher having an opening with side edges for lateral confinement of said strip spring.

9. A display assembly according to claim 8, wherein (a) said opening is formed with top, bottom and side edges for the confinement of a portion of said strip spring passing therethrough.

10. A display assembly for the display of multiple merchandise packages with provisions for moving product packages toward a front of the assembly as packages are removed by customers, which comprises (a) a display rack having a pair of spaced apart, parallel support rods mounted to extend outward in a point of purchase product display, (b) a product pusher slideably mounted on said support rods for forward and rearward movements, (c) said product pusher comprising front and back, generally flat panels of plastic material joined at top edges thereof and spaced apart at bottom edges thereof to define a generally inverted V-shaped section, (d) bottom portions of said panels being formed with openings therein for slideable reception of said support rods, (e) a guide opening in said front panel, (f) a coiled strip spring having a coiled body positioned between and confined by said front and back panels and having a portion extending forwardly through said guide opening and anchored at a front portion of said display rack, and (g) said coiled strip spring being coiled in a direction such that said coiled body thereof is positioned generally above the forwardly extending portion of said spring.

11. A display assembly according to claim 10, wherein (a) said guide opening being of closed configuration for confinement of said strip spring on all sides thereof.

12. A display assembly according to claim 10, wherein (a) said product pusher is formed of plastic material and is formed by extrusion.

13. A display assembly according to claim 10, wherein (a) said front and back panels are formed with open-sided notches at each side thereof opening at opposite side edges of said panels and located adjacent said spaced apart bottom edges thereof, (b) said panels having a width greater than the spacing between said support elements and said support elements being received within said open-sided notches.

14. A display assembly according to claim 13, wherein (a) said panels are sufficiently flexible to enable the lower edges of the front and back panels to be temporarily compressed together for mounting of said product pusher on said display rack.

15. A display assembly according to claim 10, wherein (a) said support rods are covered with a coating of paint to facilitate sliding movement of said product pusher.

16. A display assembly according to claim 10, wherein (a) said front panel is of greater height than said back panel, (b) said V-shaped section forms a normal angle between said front and back panels such that said front panel tends to lean forwardly, and (c) said rear panel has sufficient flexibility to reform from a normally flat configuration to a rearwardly bowed configuration when said front panel is displaced rearwardly to a limit position.

17. A display assembly according to claim 16, wherein (a) lower edge portions of said front and rear panels are substantially in contacting relation when said front panel is displaced rearwardly to said limit position.

18. A display assembly according to claim 17, wherein (a) said display rack includes a limit stop for limiting rearward movement of said rear panel on said support rods, and (b) said rearward limit position of said front panel is defined by lower edge portions of said rear panel when said rear panel has engaged said limit stop.

19. A display assembly according to claim 16, wherein, (a) said rear panel, in said rearwardly bowed configuration, defines a confinement space for a partially uncoiled strip spring.

20. A display assembly for the display of multiple merchandise packages with provisions for moving product packages toward the front of a assembly as packages are removed by customers, which comprises (a) a display rack comprising a pair of spaced-apart, parallel support elements arranged to extend outward in a point of purchase product display, (b) a product pusher mounted on said support elements for forward and rearward sliding movement, for urging packages to the front of said display assembly, (c) said product pusher comprising a sheet-like structure of plastic material including front and back wall panels joined along top edge margins thereof and having bottom edge margins spaced apart in the direction of said sliding movement, (d) said front and back wall panels having open-sided notches therein adjacent said bottom edge margins slideably engaging said support elements, (e) a coiled strip spring for urging said product pusher in a forward direction, (f) an anchor element at a forward end of said display rack for securing one end of said spring, (g) spaced apart internal surfaces of said product pusher forming a confinement for a coiled body of said strip spring with said coiled body urging said product pusher in a forward direction, (h) said product pusher, at least in its bottom edge margins, having a width greater than a space between said support elements whereby said product pusher is supported by engagement of opposed pairs of said open sided notches in said front and back wall panels, (i) said front wall panel being formed with a plurality of laterally spaced, horizontally disposed slots therein for receiving a plurality of strip coil springs.

21. A display assembly for the display of multiple merchandise packages with provisions for moving product packages toward the front of a assembly as packages are removed by customers, which comprises (a) a display rack comprising a pair of spaced-apart, parallel support elements arranged to extend outward in a point of purchase product display, (b) a product pusher mounted on said support elements for forward and rearward sliding movement, for urging packages to the front of said display assembly, (c) said product pusher comprising a sheet-like structure of plastic material including front and back wall panels joined along top edge margins thereof and having bottom edge margins spaced apart in the direction of said sliding movement, (d) said front and back wall panels having open-sided notches therein adjacent said bottom edge margins slideably engaging said support elements, (e) a coiled strip spring for urging said product pusher in a forward direction, (f) an anchor element at a forward end of said display rack for securing one end of said spring, (g) spaced apart internal surfaces of said product pusher forming a confinement for a coiled body of said strip spring with said coiled body urging said product pusher in a forward direction, (h) said product pusher, at least in its bottom edge margins, having a width greater than a space between said support elements whereby said product pusher is supported by engagement of opposed pairs of said open sided notches in said front and back wall panels, (i) said display rack having a cross bar element extending across a front end portion thereof, (j) said anchor element comprising a clip-on element attached to said cross bar element, said clip-on element having a slot therein for the reception and retention of an end portion of said strip coil spring.

22. A display assembly according to claim 21, wherein (a) said clip-on element comprises a label holder secured to said cross bar element and having a forwardly facing pocket for receiving and displaying a product information label, (c) said label holder having a slot in an upper portion thereof for reception and retention of an end portion of said strip coil spring.

23. A display assembly for the display of multiple merchandise packages with provisions for moving product packages toward the front of a assembly as packages are removed by customers, which comprises (a) a display rack comprising a pair of spaced-apart, parallel support elements arranged to extend outward in a point of purchase product display.

(b) a product pusher mounted on said support elements for forward and rearward sliding movement, for urging packages to the front of said display assembly, (c) said product pusher comprising a sheet-like structure of plastic material including front and back wall panels joined along top edge margins thereof and having bottom edge margins spaced apart in the direction of said sliding movement, (d) said front and back wall panels having open-sided notches therein adjacent said bottom edge margins slideably engaging said support elements, (e) a coiled strip spring for urging said product pusher in a forward direction, (f) an anchor element at a forward end of said display rack for securing one end of said spring, (g) spaced apart internal surfaces of said product pusher forming a confinement for a coiled body of said strip spring with said coiled body urging said product pusher in a forward direction, (h) said product pusher, at least in its bottom edge margins, having a width greater than a space between said support elements whereby said product pusher is supported by engagement of opposed pairs of said open sided notches in said front and back wall panels, (i) said support elements forming at least part of a support means for said product packages, (j) said display rack including additional support elements positioned between said support elements and providing additional support for said product packages, and (k) said wall panels being formed with downwardly opening notches in the bottom edge margins thereof for reception of said additional support elements.

24. A display assembly according to claim 23, wherein (a) said downwardly opening notches cooperate with said additional support elements to provide lateral guidance for said product pusher.

* * * * *